US005746578A

United States Patent [19]

Brassfield et al.

[11] Patent Number: 5,746,578

[45] Date of Patent: May 5, 1998

[54] RETENTION SYSTEM FOR BAR-TYPE DAMPER OF ROTOR

[75] Inventors: Steven R. Brassfield, Cincinnati; Alan L. Webb, Mason, both of Ohio

[73] Assignee: General Electric Company, Cincinnati, Ohio

[21] Appl. No.: 728,711

[22] Filed: Oct. 11, 1996

[51] Int. Cl.[6] ..... F01D 5/10

[52] U.S. Cl. ..... 416/190; 416/193 A; 416/248; 416/500

[58] Field of Search ..... 416/144, 145, 416/190, 193 A, 248, 500, 21 AR, 220 R

[56] References Cited

U.S. PATENT DOCUMENTS

| | | | |
|---|---|---|---|
| 3,266,770 | 8/1966 | Harlow | 416/190 |
| 4,516,910 | 5/1985 | Bouiller et al. | 416/190 |
| 5,215,442 | 6/1993 | Steckle et al. . | |
| 5,226,784 | 7/1993 | Mueller et al. | 416/248 |
| 5,261,790 | 11/1993 | Dietz et al. . | |
| 5,302,085 | 4/1994 | Dietz et al. . | |
| 5,369,882 | 12/1994 | Dietz et al. . | |

*Primary Examiner*—Christopher Verdier
*Attorney, Agent, or Firm*—Andrew C. Hess; Patrick R. Scanlon

[57] ABSTRACT

A rotor blade for a rotor of a gas turbine engine having an axis of rotation including a root portion, a platform portion connected to the root portion and having a damper pocket formed therein, an airfoil portion connected to the platform portion, a generally bar-shaped damping member loosely arranged in the damper pocket having at least one scrubbing surface, and at least one leg extending from the bar-shaped damping member for retaining the bar-shaped damping member in the damper pocket. The bar-shaped damping member is slidably displaceable and rotatable within the damper pocket during rotation of the rotor. The damper pocket in the platform portion has a rear surface with an upper portion and a lower portion at an angle to the upper portion, a pair of spaced side surfaces, and a pair of spaced lower surfaces extending from the rear surface lower portion which are substantially coplanar. The damper pocket lower surfaces are provided by a first blade tab extending laterally inward from one of the side surfaces and a second blade tab extending laterally inward from the other side surface, where a leg connected to the bar-shaped damping member extends through a slot in at least one of the first and second blade tabs so as to retain the bar-shaped damping member within the damper pocket.

14 Claims, 2 Drawing Sheets

RETENTION SYSTEM FOR BAR-TYPE DAMPER OF ROTOR

BACKGROUND OF THE INVENTION

1. Field of the Invention

The present invention relates generally to rotors of turbines and compressors in a gas turbine engine and, more particularly, to a means for retaining a bar type damper in turbine and compressor blades.

2. Description of Related Art

The rotor of a turbine or compressor in a gas turbine engine includes a plurality of blades which are circumferentially distributed on a disk for rotation therewith about the disk axis. A conventional rotor blade has a root or dovetail portion which is slidably received in a complementarily configured recess provided in the rotor disk, a platform portion located outside the rotor disk, an airfoil portion extending radially outwardly from the platform and in some cases a segmented shroud located at the tips of the airfoils, each shroud segment being connected to a corresponding blade tip.

The platforms of the rotor blades collectively define a radially outwardly facing wall and the tip shroud segments collectively define a radially inwardly facing wall of an annular gas flow passageway through the engine. The airfoils of the rotor blades extend radially into the passageway to interact aerodynamically with the gas flow therethrough. These airfoils are subject to vibrations which cause high cycle fatigue, so it is necessary to damp such vibrations to reduce the fatigue on the blades (particularly at or near resonant frequencies).

Various types of blade dampers are well known in the art. For example, one type of damper consists of certain wedge-shaped damping members being arranged in a corresponding wedge-shaped pocket formed in the root cavity of the blade and having two scrubbing surfaces. It is seen that this wedge-shaped damping member is retained in the pocket by means of a retainer pin in U.S. Pat. No. 5,302,085 and a hook-shaped metal clip in U.S. Pat. No. 5,261,790. While these wedge-shaped damping members are adequate in terms of providing a damping function, they do not function as seals between the platforms of adjacent blades.

Accordingly, a bar type damper for rotor blades has been developed which provides both the damping and sealing functions desired. In particular, the bar damper acts as an axial platform seal in turbine blades to reduce the ingestion of hot flowpath gases into the blade shank cavity region, which results in a reduction of disk post metal temperatures and an improvement in disk creep capability. It has been found, however, that the bar damper is not able to be utilized in certain applications because of the need to remove the rotor blades thereof during assembly and disassembly. This has led to the possibility of bar dampers falling out of the blade damper pocket and causing foreign object damage to the engine.

Accordingly, it would be desirable for a mechanism to be developed which retains a bar damper within a corresponding damper pocket of a rotor blade, whereby damping of vibrations experienced by the rotor blade and sealing between adjacent platforms of rotor blades may be accomplished without the risk of such bar dampers falling into the core of the engine during assembly or disassembly. It would also be desirable for the bar damper to be retained without resorting to a permanent connection, such as welding or the like, in order to ease manufacture, reduce cost, and facilitate removal/replacement when the rotor blade undergoes repair after field operation.

SUMMARY OF THE INVENTION

In accordance with one aspect of the present invention, a rotor blade for a rotor of a gas turbine engine having an axis of rotation is disclosed as including a root portion, a platform portion connected to the root portion and having a damper pocket formed therein, an airfoil portion connected to the platform portion, a generally bar-shaped damping member loosely arranged in the damper pocket having at least one scrubbing surface, and means for retaining the bar-shaped damping member in the damper pocket. The bar-shaped damping member is slidably displaceable and rotatable within the damper pocket during rotation of the rotor. The damper pocket in the platform portion has a rear surface with an upper portion and a lower portion at an angle to the upper portion, a pair of spaced side surfaces, and a pair of spaced lower surfaces extending from the rear surface lower portion which are substantially coplanar. The damper pocket lower surfaces are provided by a first blade tab extending laterally inward from one of the side surfaces and a second blade tab extending laterally inward from the other side surface, where a leg connected to the bar-shaped damping member extends through a slot in at least one of the first and second blade tabs so as to retain the bar-shaped damping member within the damper pocket.

In accordance with a second aspect of the present invention, a rotor assembly for a gas turbine engine is disclosed as including a rotor disk having means for receiving a root portion of a rotor blade arranged on the outer circumference of the rotor disk, at least one rotor blade received by the receiving means of the rotor disk, and means for rotatably supporting the rotor disk for rotation about an axis. The rotor blade includes a root portion, a platform portion connected to the root portion and having a damper pocket formed therein, an airfoil portion connected to the platform portion, and a generally bar-shaped damping member loosely retained in the damper pocket having at least one scrubbing surface.

BRIEF DESCRIPTION OF THE DRAWING

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Figure 1:
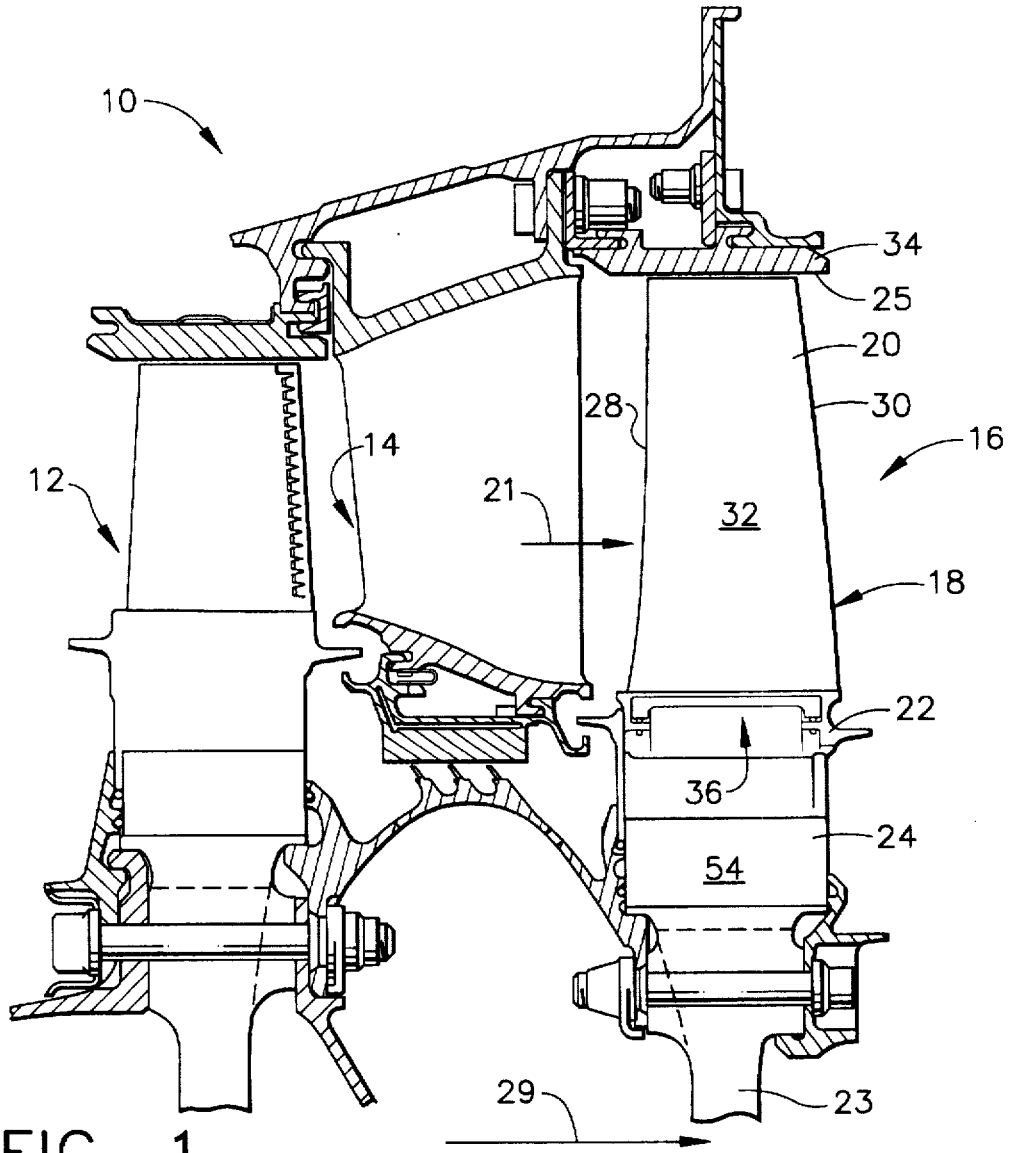
FIG. 1 is a partial cross-sectional view of a high pressure turbine in a gas turbine engine, where a bar damper for the second stage rotor is shown as being retained within the damper pocket thereof in accordance with the present invention.

Referring now to the drawings in detail, wherein identical numerals indicate the same elements throughout the figures, FIG. 1 partially depicts a turbine 10 for a gas turbine engine. It will be seen that turbine 10 includes a first stage rotor 12, a stator 14, and a second stage rotor 16. While the present invention will be described with respect to a turbine blade 18 of second stage rotor 16, it will be understood that it may just as easily be applied to any number of rotor blades of any stage in either a turbine or a compressor of a gas turbine engine.

As seen in FIG. 1, turbine blade 18 includes an airfoil portion 20, a platform portion 22, and a root (or dovetail) portion 24. A plurality of such blades are circumferentially distributed on the periphery of a rotor disk 23, where root portion 24 of each turbine blade 18 slides into a complementarily configured axially disposed recess (not shown) in rotor disk 23 and secures turbine blade 18 to rotor disk 23.

Airfoil portion 20 of each turbine blade 18 extends radially outwardly into an annular flow passageway 21 defined between radially outwardly facing cylindrically segmented surfaces 26 of platforms 22 and a radially inwardly facing surface 25 of a tip shroud 34. Rotor 16 is journalled for rotation about a horizontal axis 29 (see FIG. 1) such that airfoil portion 20 of turbine blades 18 rotate in annular flow passageway 21 in response to axial flow of gas from a combustor (not shown) through passageway 21. It will be understood that each airfoil portion 20 has a rounded leading edge 28 directed toward the gas flow, a trailing edge 30, a concave pressure surface 32, and a convex suction surface (not shown).

Figure 2:
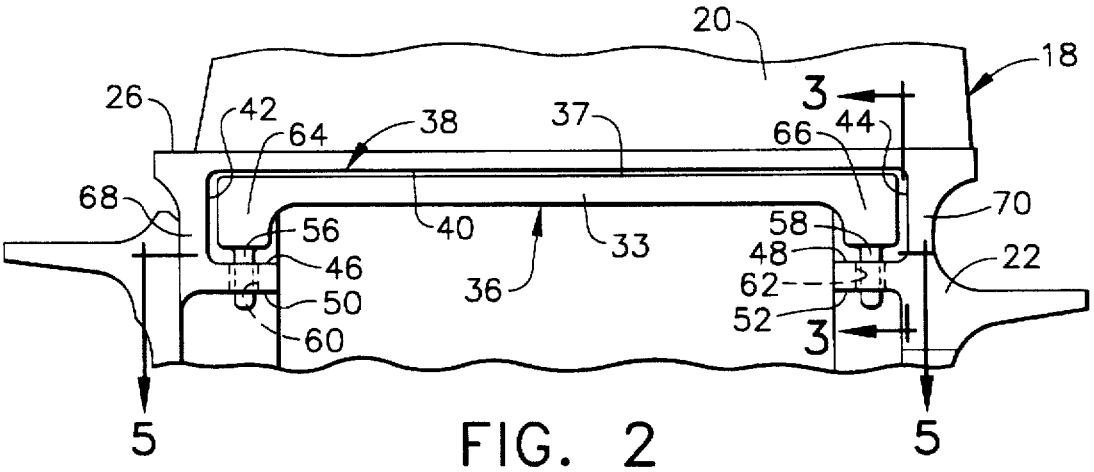
FIG. 2 is an enlarged view of the platform portion for a turbine blade of the second stage rotor depicted in FIG. 1.
Figure 3:
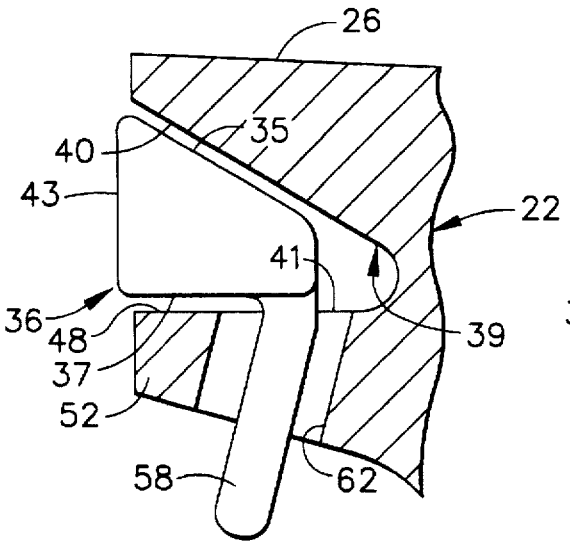
FIG. 3 is an enlarged partial cross-sectional view of the turbine blade platform portion along line 3—3 of FIG. 2, where a straight damper leg extending through a slot in a blade tab is shown.
Figure 4:
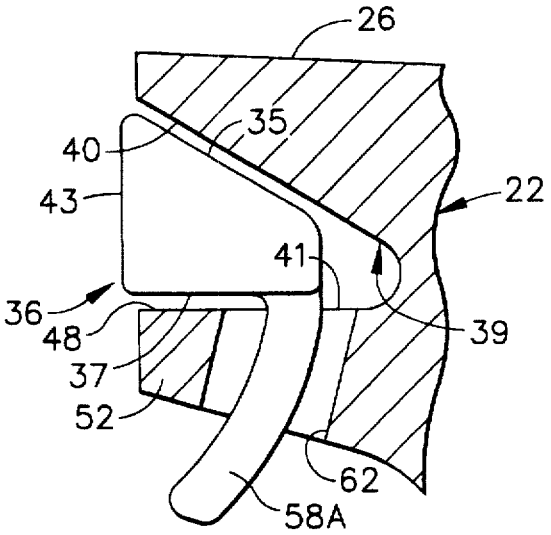
FIG. 4 is an enlarged partial cross-sectional view of the turbine blade platform portion along line 3—3 of FIG. 2, where a curved damper leg extending through a slot in a blade tab is shown.

The entire rotor blade is preferably an integrally formed cast-and-machined member. Airfoil portion 20 of turbine blade 18 extends radially outwardly from platform radially outer surface 26 to tip shroud 34 with respect to turbine blade 18. When exposed to the gas flow, airfoil portion 20 is subjected to both flexural and torsional stresses. Accordingly, a damper 36 is provided within a damper pocket 38 formed in platform portion 22 below platform radially outer surface 26. It is best seen in FIGS. 2–4 that damper pocket 38 is substantially triangular in cross-section and defined by a rear surface 39 having an upper portion 40 and a lower portion 41 at an angle to upper portion 40, a pair of spaced side surfaces 42 and 44, and a pair of spaced lower surfaces 46 and 48 extending from lower portion 41 of rear surface 39. It will be noted that lower surfaces 46 and 48 are provided by the upper surfaces of a pair of substantially coplanar blade tabs 50 and 52 which extend inward from side surfaces 42 and 44, respectively, and are located a distance below outwardly facing surface 26 of platform portion 22.

A number of damper designs have been employed previously within the art, as detailed above. While the primary function of such a damper is to provide one or more surfaces which may be scrubbed against by platform portion 22, and thereby create friction to deter the stresses imposed upon turbine blade 18, it is preferred that such damper also function as an axial platform seal to reduce the ingestion of hot flowpath gases into a shank cavity region 54 within root portion 24 of turbine blade 18. This results in a reduction of disk post metal temperatures and an improvement in disk creep capability. One such damper which is able to perform both functions is a bar-type damper having an elongated design that extends substantially across the entire width of damper pocket 38, as shown in FIG. 2.

With respect to at least certain applications, it has become necessary for turbine blades 18 of rotor 16 to be removed during assembly and disassembly of an adjacent nozzle assembly. Because bar-type dampers 36 have heretofore been positioned loosely within damper pocket 38, the possibility of a damper 36 falling out of its respective damper pocket 38 and into the core engine has been significant. Thus, in order to prevent potential foreign object damage to the gas turbine engine, it has become necessary to provide an appropriate means for retaining damper 36 within damper pocket 38. Although other damper designs have included retention devices, as seen for the wedge-shaped dampers disclosed in U.S. Pat. Nos. 5,302,085 and 5,261,790, they are not applicable to bar damper 36 utilized herein. It is further preferred that the retention means provided not interfere with airflow around and within platform portion 22 and root portion 24 in order to be consistent with current design practice.

As seen in FIGS. 3 and 4, bar damper 36 is designed in terms of size and shape to fit within damper pocket 38 and therefore preferably has a substantially triangular cross-section in which a first surface 35 is substantially parallel to upper portion 40 of damper pocket rear surface 39, a second surface 37 is substantially parallel to lower portion 41 of damper pocket rear surface 39, and a third surface 43 is substantially parallel to a front opening of damper pocket 38. In accordance with the present invention, a pair of legs 56 and 58 extend from a body portion 33 of bar damper 36 and are inserted through slots 60 and 62, respectively, of interior platform blade tabs 50 and 52. Legs 56 and 58 are positioned so as to extend from ends 64 and 66, respectively, of bar damper body portion 33 where they preferably are part of a one-piece design for bar damper 36 (although legs 56 and 58 may be permanently connected to bar damper body portion 33 (such as by welding or the like). It will be noted that legs 56 and 58, blade tabs 50 and 52, and slots 60 and 62 have been sized and arranged to permit bar damper 36 to move (or be displaced) within damper pocket 38. Additionally, bar damper 36 is allowed to rotate to some extent so that first surface 35 thereof is properly seated against upper portion 40 of damper pocket rear surface 39 during rotation of rotor 16 (due to centrifugal forces imposed thereon). When legs 56 and 58 of bar damper 36 are substantially linear (as shown in FIG. 3), bar damper 36 is then able to move in a plane substantially perpendicular to rotation axis 29 since legs 56 and 58 are preferably oriented radially outward and substantially perpendicular with respect to rotation axis 29. Alternatively, legs 56 and 58 may be curved or substantially arcuate (as shown in FIG. 4 with respect to leg 58A) in order to facilitate insertion of legs 56 and 58 into slots 60 and 62, and therefore bar damper 36 in damper pocket 38. In either case, first surface 35 may be used as a scrubbing surface by platform portion 22 of turbine blade 18.

Figure 5:
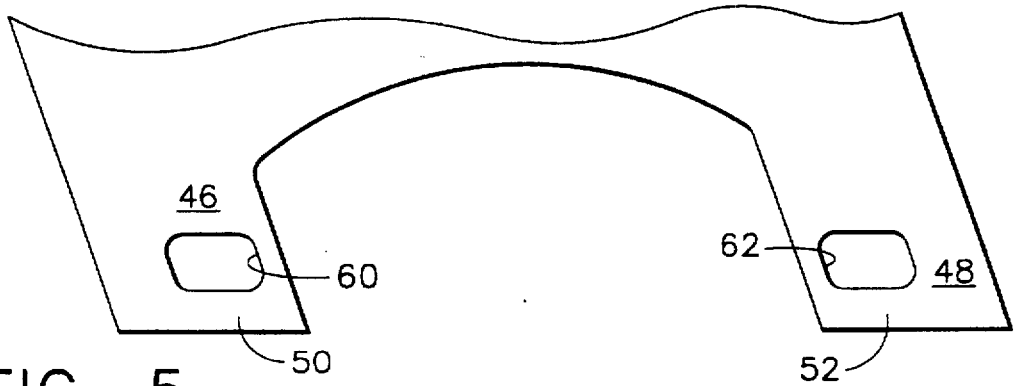
FIG. 5 is a diagrammatic top view of the platform blade tabs depicted in FIG. 2 taken along line 5—5.
Figure 6:
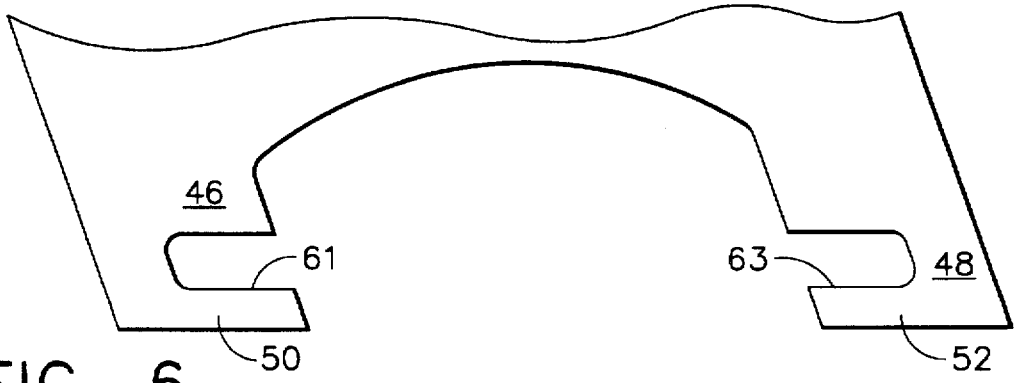
FIG. 6 is a diagrammatic top view of an alternative configuration for the platform blade tabs depicted in FIG. 2 taken along line 5—5.

It will further be noted that slots 60 and 62 in blade tabs 50 and 52 may be either cast into or machined so that they are completely enclosed as depicted in FIG. 5 or open on at least one side thereof as shown for slots 61 and 63 in FIG. 6. Legs 56 and 58 of bar damper 36 are retained within damper pocket 38 regardless of which design of slots 60 and 62 is used, although each design may have its own advantages in terms of cost, ease of implementation, or retention ability.

Having shown and described the preferred embodiment of the present invention, further adaptations of the retention means for a bar damper in a rotor blade can be accomplished by appropriate modifications by one of ordinary skill in the art without departing from the scope of the invention. For example, while it is possible that a leg could be coupled to one or more ends of bar damper 36 so as to extend laterally through at least one of side walls 68 and 70 of platform portion 22 to retain bar damper 36 within damper pocket 38, this alternative is deemed less desirable since it would require an elongated slot in side walls 68 and 70 to allow vertical movement of bar damper 36. Additionally, the legs in such a configuration would have the negative effect of obstructing air flow around platform portion 22.

What is claimed is:

1. A rotor blade for a rotor of a gas turbine engine having an axis of rotation, comprising:

(a) a root portion;

(b) a platform portion connected to said root portion and having a damper pocket formed therein, said damper pocket having a substantially triangular cross-section and further comprising:

(1) a rear surface having an upper portion and a lower portion at an angel to said upper portion;

(2) a pair of spaced side surfaces; and (3) a of spaced, substantially coplanar lower surfaces extending from said rear surface lower portion said damper pocket lower surfaces being provided by a first blade lab extending laterally inward from one of said side surfaces and a second blade tab extending laterally inward from the other of said side surfaces;

(c) an airfoil portion connected to said platform portion; and (d) a generally bar-shaped damping member loosely arranged in said damper pocket having at least one scrubbing surface said bar-shaped damping member including a first leg extending therefrom through a slot in at least one of said first and second blade tabs so as to retain saw bar-shaped damping member in said damper pocket.

2. The rotor blade of claim 1, wherein said bar-shaped damping member is slidably displaceable within said damper pocket.

3. The rotor blade of claim 1, wherein said bar-shaped damping member is rotatable within said damper pocket during rotation of said rotor.

4. The rotor blade of claim 1, further comprising a second leg extending from said bar-shaped damping member so that said first and second legs extend from opposite ends of said bar-shaped damping member through said slots in said first and second blade tabs, respectively.

5. The rotor blade of claim 1, wherein said leg is substantially linear.

6. The rotor blade of claim 1, wherein said leg is curved.

7. The rotor blade of claim 1, wherein said rotor is located within a compressor of said gas turbine engine.

8. The rotor blade of claim 1, wherein said rotor is located within a turbine of said gas turbine engine.

9. The rotor blade of claim 1, wherein said slot in at least one of said first and second blade tabs is closed.

10. The rotor blade of claim 1, wherein said slot in at least one of said first and second blade tabs is partially open.

11. The rotor blade of claim 1, wherein said leg is oriented substantially perpendicular to said bar-shaped damping member.

12. A rotor assembly for a gas turbine engine, comprising:

(a) a rotor disk including means for receiving a root portion of a rotor blade arranged on the outer circumference of said rotor disk;

(b) at let one rotor blade, comprising:

(1) a root portion received by said receiving means of said rotor disk;

(2) a platform portion connected to said root portion and having a damper pocket formed therein, said damper pocket having a substantially triangular cross-section and including:

(a) a rear surface having an upper portion and a lower portion at an angle to said upper portion;

(b) a pair of spaced side surfaces; and (c) a pair of spaced, substantially coplanar lower surfaces extending from said rear surface lower portion, said damper pocket lower surfaces being provided by a first blade tab extending laterally inward from one of said side surfaces and a second blade tab extending laterally inward from the other of said side surfaces;

(3) an airfoil portion connected to said platform portion;

(4) a generally bar-shaped damping member loosely arranged in said damper pocket having at least one scrubbing surface, said bar-shaped damp in member further comprising first and second legs extending from opposite ends of said bar-shaped damping member through said first and second blade tabs, respectively, so as to retain said bar-shaped damping member within said damper pocket.

13. The rotor assembly of claim 12, wherein said legs are curved.

14. The rotor assembly of claim 12, wherein said legs are oriented substantially perpendicular to said bar-shaped damping member.

* * * * *